US009486084B2

(12) United States Patent
Connell et al.

(10) Patent No.: US 9,486,084 B2
(45) Date of Patent: Nov. 8, 2016

(54) ILLUMINABLE INDICATOR FOR A BED

(71) Applicant: Stryker Corporation, Kalamazoo, MI (US)

(72) Inventors: Jason Connell, London (CA); Richard Roussy, London (CA)

(73) Assignee: Stryker Corporation, Kalamazoo, MI (US)

( * ) Notice: Subject to any disclaimer, the term of this patent is extended or adjusted under 35 U.S.C. 154(b) by 17 days.

(21) Appl. No.: 14/350,809

(22) PCT Filed: Oct. 9, 2012

(86) PCT No.: PCT/CA2012/000933
§ 371 (c)(1),
(2) Date: Apr. 9, 2014

(87) PCT Pub. No.: WO2013/053040
PCT Pub. Date: Apr. 18, 2013

(65) Prior Publication Data

US 2014/0313700 A1 Oct. 23, 2014

Related U.S. Application Data

(60) Provisional application No. 61/545,190, filed on Oct. 9, 2011.

(51) Int. Cl.

| | |
|---|---|
| ***A47C 17/86*** | (2006.01) |
| ***A61G 7/05*** | (2006.01) |
| ***F21V 33/00*** | (2006.01) |
| *F21Y 101/00* | (2016.01) |

(52) U.S. Cl.
CPC ..... *A47C 17/86* (2013.01); *A61G 7/05* (2013.01); *A61G 7/0506* (2013.01); *F21V 33/0012* (2013.01); *F21V 33/0072* (2013.01); *A61G 2203/723* (2013.01); *F21Y 2101/00* (2013.01); *F21Y 2113/10* (2016.08)

(58) Field of Classification Search
CPC ..... A47C 21/003; F21V 33/0072
See application file for complete search history.

(56) References Cited

U.S. PATENT DOCUMENTS

| | | | | |
|---|---|---|---|---|
| 5,450,639 | A | 9/1995 | Weismiller et al. | |
| 6,234,642 | B1 * | 5/2001 | Bokamper | A47C 21/003 362/130 |
| 8,344,860 | B2 | 1/2013 | Collins, Jr. et al. | |

(Continued)

FOREIGN PATENT DOCUMENTS

| | | | |
|---|---|---|---|
| EP | 2345396 | A2 | 7/2011 |
| JP | 11032869 | A | 9/1999 |

OTHER PUBLICATIONS

Supplementary European Search Report for application No. 12840160.1, the European counterpart to U.S. Appl. No. 14/350,809.

(Continued)

*Primary Examiner* — Anne Hines
(74) *Attorney, Agent, or Firm* — Warner Norcross & Judd LLP

(57) ABSTRACT

An illuminable indicator for a bed includes a body configured to be attached to the bed. The body can include a resilient portion and a light-transmitting portion. The body can be shaped to protrude from an outer perimeter of the bed. A light source can be positioned to emit light to the light-transmitting portion to illuminate the body.

38 Claims, 10 Drawing Sheets

(56) References Cited

U.S. PATENT DOCUMENTS

| | | | | |
|---|---|---|---|---|
| 8,464,380 | B2 | 6/2013 | Bobey et al. | |
| 8,537,008 | B2 | 9/2013 | Tallent et al. | |
| 8,593,284 | B2 | 11/2013 | Tallent et al. | |
| 8,689,376 | B2 | 4/2014 | Becker et al. | |
| 8,844,076 | B2 | 9/2014 | Becker et al. | |
| 2001/0038534 | A1 | 11/2001 | Galli | |
| 2003/0119613 | A1 | 6/2003 | Samuel et al. | |
| 2007/0032319 | A1 | 2/2007 | Tufte | |
| 2008/0201847 | A1* | 8/2008 | Menkedick | A61B 5/1115 5/600 |
| 2009/0211026 | A1 | 8/2009 | Schoff | |
| 2010/0073168 | A1 | 3/2010 | Tallent et al. | |
| 2013/0276237 | A1 | 10/2013 | Bobey et al. | |
| 2014/0000032 | A1 | 1/2014 | Dixon et al. | |
| 2014/0015677 | A1 | 1/2014 | Tallent et al. | |
| 2015/0000035 | A1 | 1/2015 | Becker et al. | |

OTHER PUBLICATIONS

Supplementary European Search Report and Written Opinion, dated Jun. 16, 2015, for European patent application EP 12840160, corresponding to U.S. Appl. No. 14/350,809.

European Written Opinion dated Mar. 2, 2016 for European patent application EP 12840160.1, corresponding to U.S. Appl. No. 14/350,809.

* cited by examiner

ILLUMINABLE INDICATOR FOR A BED

CROSS-REFERENCE TO RELATED APPLICATIONS

This Application is a 35 U.S.C. 371(c) National Entry of International Application PCT/CA2012/000933 filed Oct. 9, 2012, which claims domestic benefit of U.S. Application 61/545,190 filed Oct. 9, 2011.

FIELD

This disclosure relates to beds, and more particularly, to an illuminable indicator for a bed.

BACKGROUND

Beds, such as those used in hospitals and nursing homes, often have need for indicators to communicate the status of the bed's occupant, the status of the bed itself, or the status of related equipment.

In the past, these indicators have been provided as small lights or LEDs, typically mounted on the bed rail or footboard, often as part of a membrane keypad. These lights are not readily visible to the patient attendants, particularly from outside the room when walking past. In addition, the lights can sometimes be obstructed by third-party bed mounted equipment or bed linens. The lights can also be difficult to see in bright ambient environments.

It would therefore be desirable to provide improved illuminable indicators for beds, particularly indicators that mitigate some or all of the aforementioned problems in the art.

Beds often provided with rubber bumpers located at the corners of the bed to prevent damage to the bed or hospital room walls when the bed is being moved. These bumpers are typically made from an opaque rubber material. The opaque color is due to the use of fillers, which impart improved strength and abrasion resistance to the rubber. Fillers are also useful in making the rubber non-marking. In certain beds, the bumpers are a round doughnut shaped disk of elastomeric material mounted to the underside of the bed frame at the corners of at least the foot end of the bed, and sometimes the head end of the bed. The bumpers extend outwardly from the side and foot and of the bed to keep the corners of the bed from damaging walls or equipment.

It would be desirable to provide improved bumpers for beds.

SUMMARY

An illuminable indicator for a bed is provided.

A bed having at least one illuminable indicator is provided.

A method of illuminating an indicator on a bed according to a timer is provided.

BRIEF DESCRIPTION

The drawings illustrate, by way of example only, embodiments of the present disclosure.

Figure 8A:
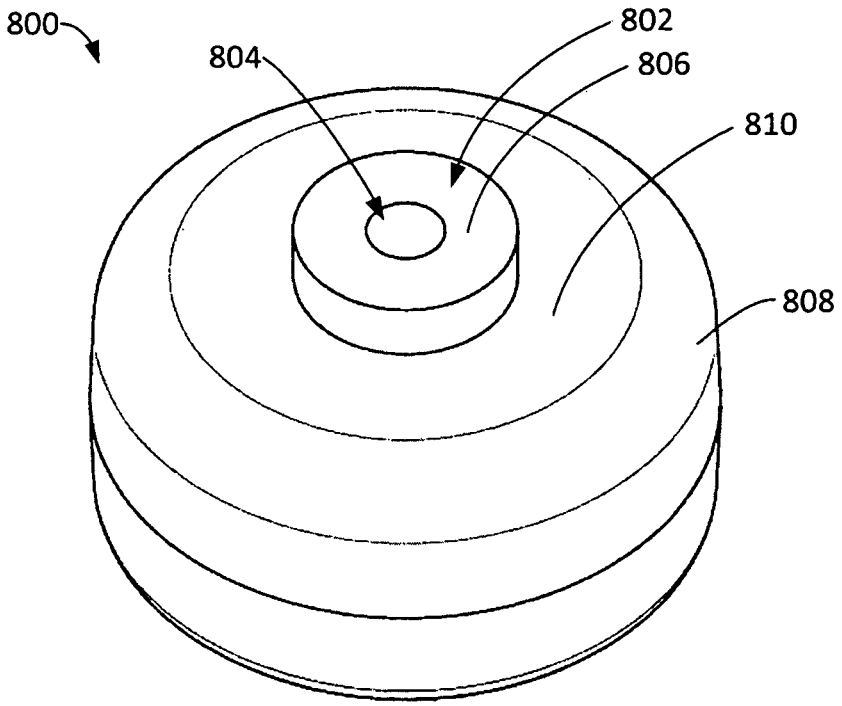

FIG. 8*a* is a perspective view of a first alternative body for an illuminable indicator.

Figure 8B:
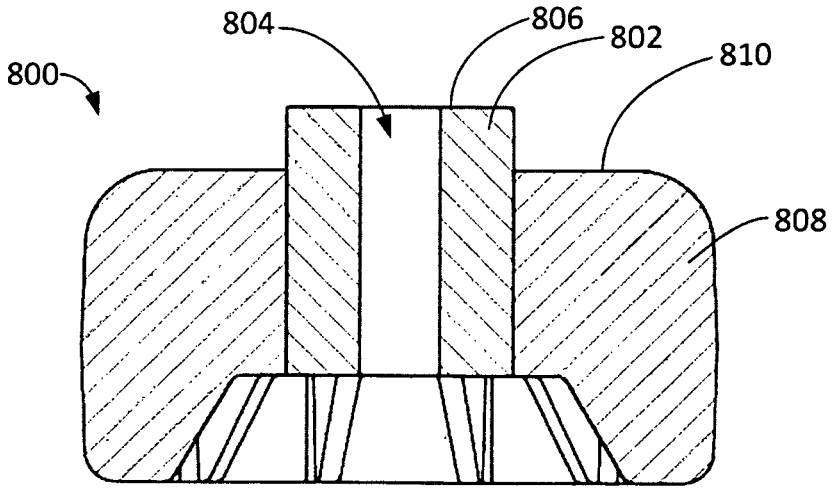

FIG. 8*b* is cross-sectional view of the body of FIG. 8*a*.

Figure 9B:
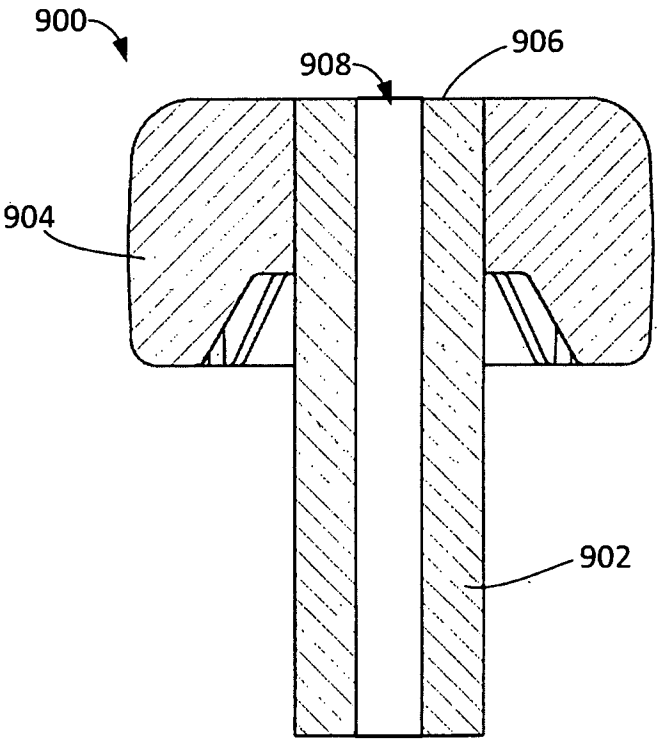
Figure 9A:
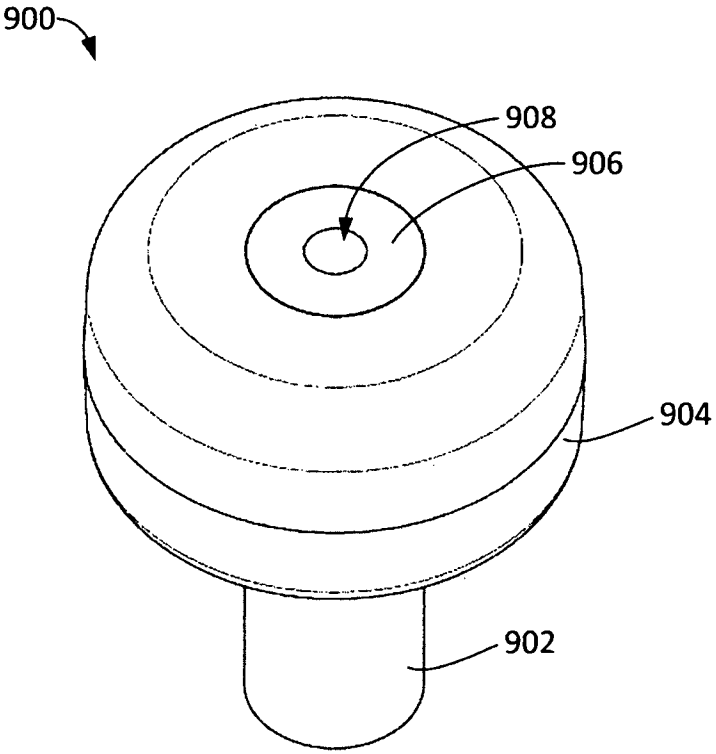

FIG. 9*a* is a perspective view of a second alternative body for an illuminable indicator.

FIG. 9*b* is cross-sectional view of the body of FIG. 9*a*.

Figure 10A:
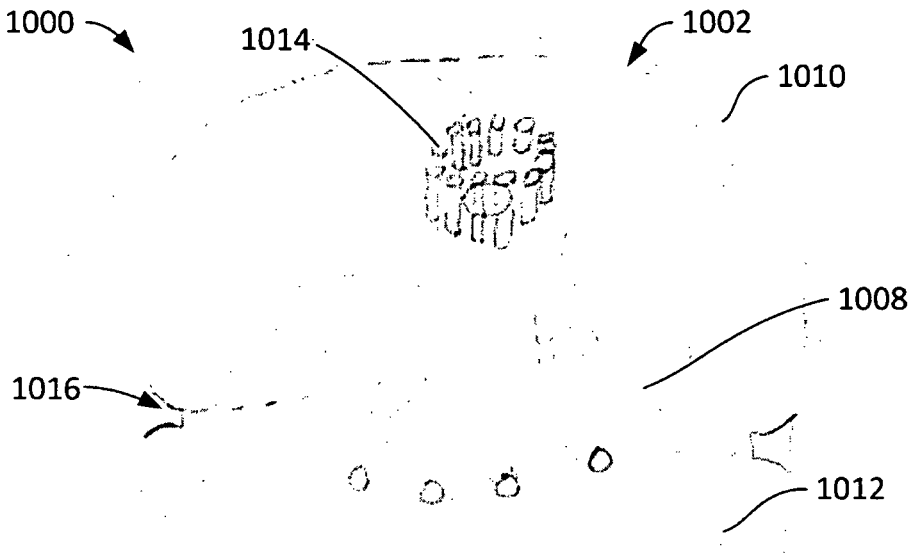

FIG. 10*a* is a perspective view of a third alternative body for an illuminable indicator.

Figure 10B:
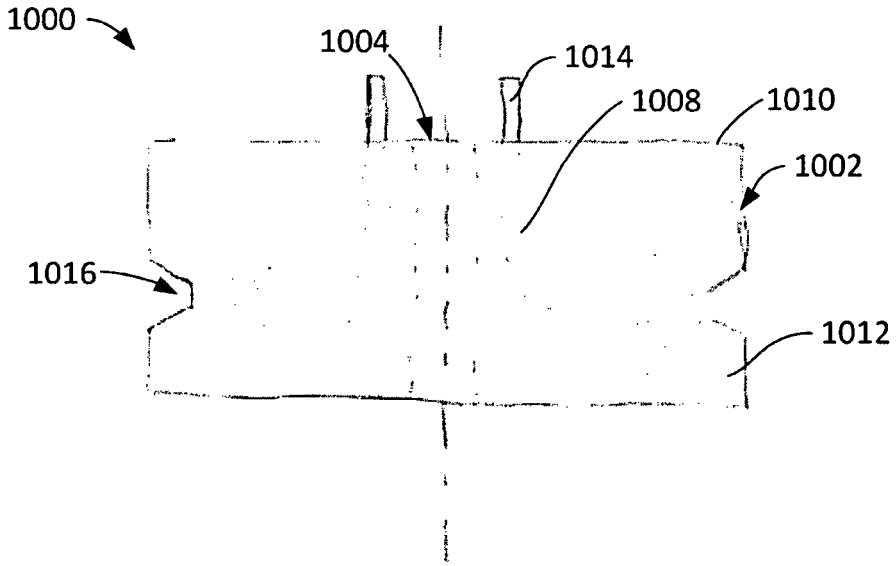

FIG. 10*b* is cross-sectional view of the body of FIG. 10*a*.

Figure 11B:
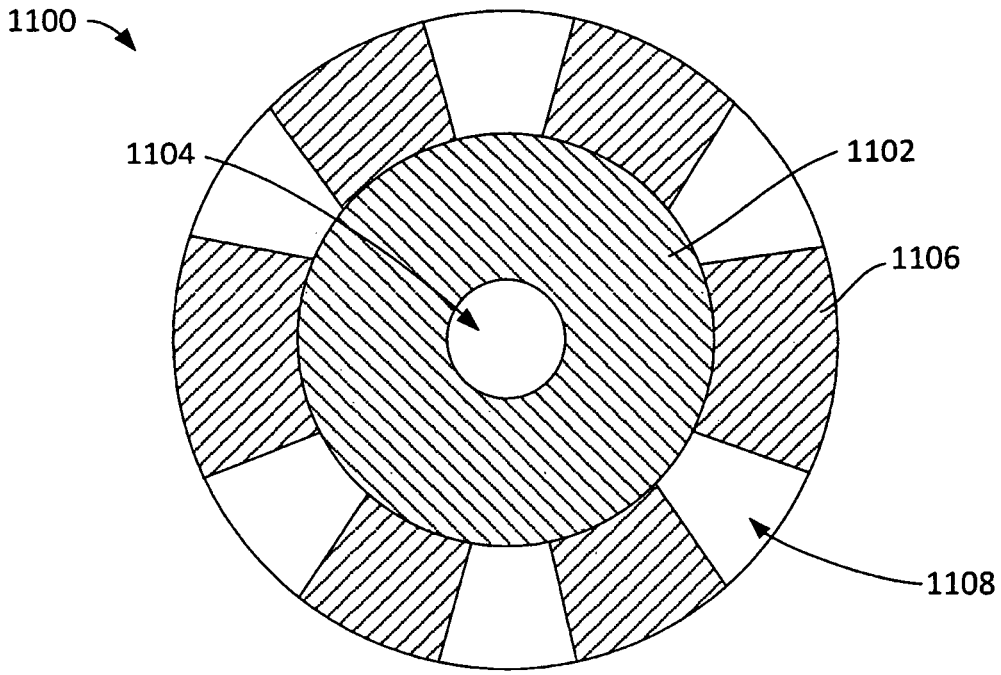
Figure 11A:
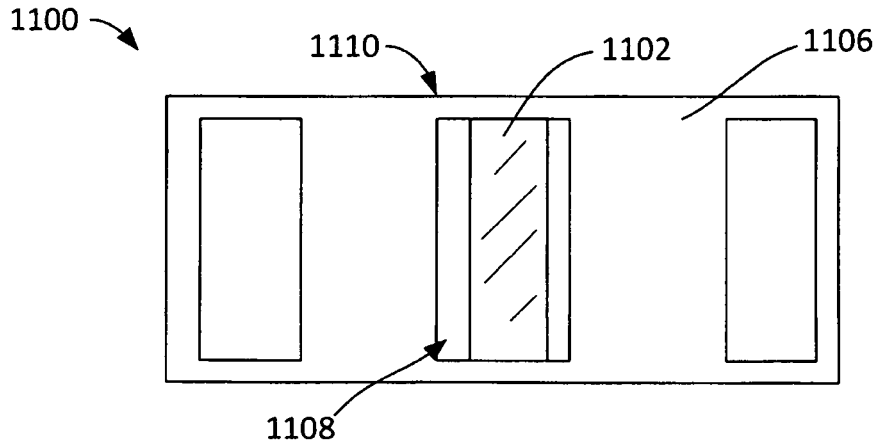

FIG. 11*a* is a side view of a fourth alternative body for an illuminable indicator.

FIG. 11*b* is cross-sectional view of the body of FIG. 11*a*.

DETAILED DESCRIPTION

Figure 1:
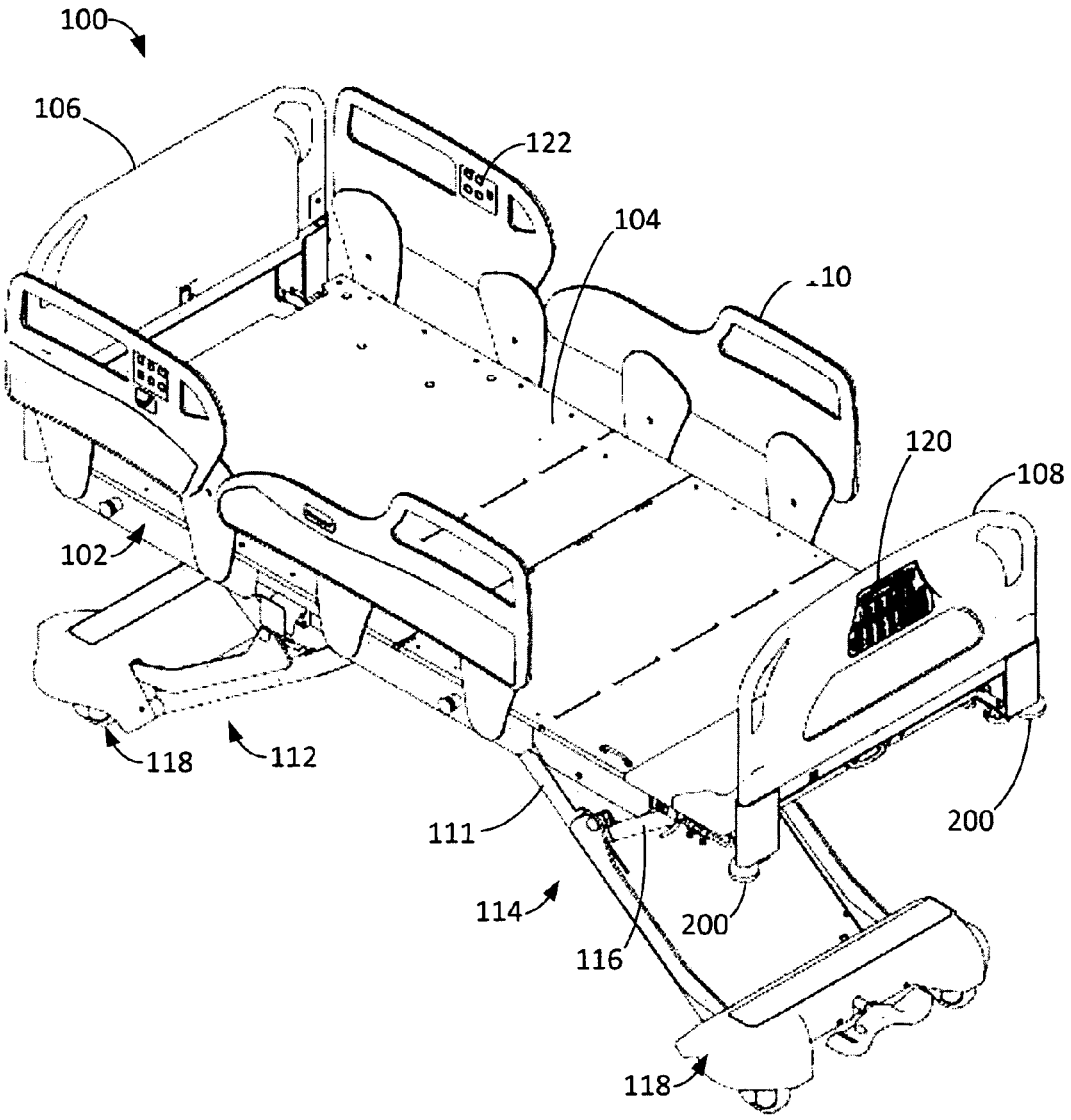
FIG. 1 is a perspective view of a bed having several illuminable indicators.

FIG. 1 illustrates an example of a height-adjustable bed 100 for use as a hospital bed or long-term care bed. The bed 100 includes a substantially horizontal bed frame 102 with an adjustable mattress support 104 positioned thereon to receive a person. In this example, the mattress support 104 has an upper-body portion capable of tilting up and down and a knee portion that may be separately adjusted. At the head of the bed 100 is a headboard 106, while an end board 108 is connected to the bed frame 102 at the foot end of the bed 100. Side rails 110 are positioned on each side of the bed 100. Such side rails 110 may be moveable so as to facilitate entry and exit of a person.

The bed 100 includes two leg assemblies 112, 114, each having two legs 111. The head leg assembly 112 is connected at the head of the bed 100 and the foot leg assembly 114 is connected at the foot of the bed 100. Upper portions of the legs 111 of the leg assemblies 112, 114 are connected to one or more linear actuators that can move the upper portions of the legs 111 back and forth along the length of the bed 100. Leg braces 116 pivotably connected to the legs 111 and to the bed frame 102 constrain the actuator movement applied to the legs 111 to move the leg assemblies 112, 114 in a manner that raises and lowers the bed frame 102. In other words, the leg assemblies 112, 114 can be said to be linkages that collapse and expand to respectively lower and raise the bed frame 102. The lower ends of the leg assemblies 112, 114 are connected to caster assemblies 118 that have caster wheels that allow the bed 100 to be moved to different locations.

Other height adjustable leg configurations may be provided, for example where the casters are connected to one another by a rectangular frame, thereby allowing the leg brace to be optionally omitted.

The bed 100 further includes an attendant's control panel 120 at the end board 108 that can, among other things, control the height of the bed frame 102, as well as the tilt of the upper-body portion of the mattress support 104 and a knee-height adjustment. To allow for similar adjustment, an occupant's control panel 122 can be provided, for example, on a side rail.

It should be emphasized that the bed 100 is merely one example of a bed that may be used with the example control systems and methods described herein. Other examples of beds that can be used with the indicators and methods described herein include ultra-low type height-adjustable beds such as those disclosed in US Patent Publication No. 2011/113556 and U.S. Pat. No. 7,003,828, the entirety of both documents being included herein by reference.

The bed 100 further includes at least one illuminable indicator 200. In this embodiment, two illuminable indicators 200 are provided, though in other examples more or fewer can be used. Since one or more illuminable indicators 200 can be used, portions of this disclosure will use the term "illuminable indicator" in the singular form. This is not intended to be limiting.

An illuminable indicator may also be known as a status indicator or light, an alert indicator or light, a warning indicator or light, or an alarm indicator or light.

When a plurality of illuminable indicators 200 is used, the illuminable indicators 200 can be generally arranged about an outer perimeter of the bed 100, and can be arranged to cast light to most if not substantially all vantage points around the bed 100. In this example, the two illuminable indicators 200 are arranged to be visible when the head of the bed 100 is near a wall by providing them at opposite corners of the foot end of the bed. Arranging the illuminable indicators 200 in this manner may help a person, such as an attendant or nurse in the vicinity of the bed 100 or outside the room that contains the bed 100, to more readily see at least one of the illuminable indicators 200. The illuminable indicator 200, or a portion thereof such as a body, extends below the bed frame 102. In this embodiment, the illuminable indicator 200 is configured to be attached at the corner of the bed frame 102, for example to the bottom end of a post near one or both ends of the end board 108. In other embodiments, an illuminable indicator 200 can be configured to be attached to any other portion of the bed 100 which results in at least a portion of the illuminable indicator 200 extending below the bed frame 102. For instance, in another embodiment an illuminable indicator 200 can be attached to one or more of the caster assemblies 118. In yet another embodiment, illuminable indicators 200 are attached at the four corners of the bed 100 below the bed frame 102. Such positioning of the illuminable indicators 200 below the bed frame 102 may help at least one of the illuminable indicators 200 to be seen, while using space that has not found much practical use before now. The indicator 200 is attached to the bed in a manner that allows a least a portion of the indicator to project outwardly of the bed in either the side direction, end direction, or both directions for improved visibility and for other reasons that will be described in greater detail hereinafter.

The illuminable indicator 200 can provide information to a person, such as an attendant or nurse, within vantage of the bed 100 or a portion thereof. Such information can include different conditions conveyed by light emitted by the illuminable indicator 200, and such light can be of different colors, intensities, flashing patterns, or a combination thereof. Different conditions can include a condition of the occupant of the bed (e.g., moving or not, attempting to exit, pressing a call-attendant button, etc.), a condition of the bed (e.g., malfunction, low battery, etc.), or the function of related equipment (e.g., a heart monitor, an intravenous drip device, etc.), and can include a normal condition, a warning condition, and/or an alarm condition.

The illuminable indicator 200 can be configured to emit light according to a reminder alert, which can be set by a nurse or attendant to remind him or her to conduct a specific task after a pre-specified time interval or condition. For example, a reminder alert may be set to remind the nurse or attendant to administer medication to the occupant of the bed 100 after a specific duration has elapsed.

In this example, the illuminable indicators 200 also act as bed bumpers, as will be discussed in more detail below along with elaboration on the above concepts.

Figure 2:
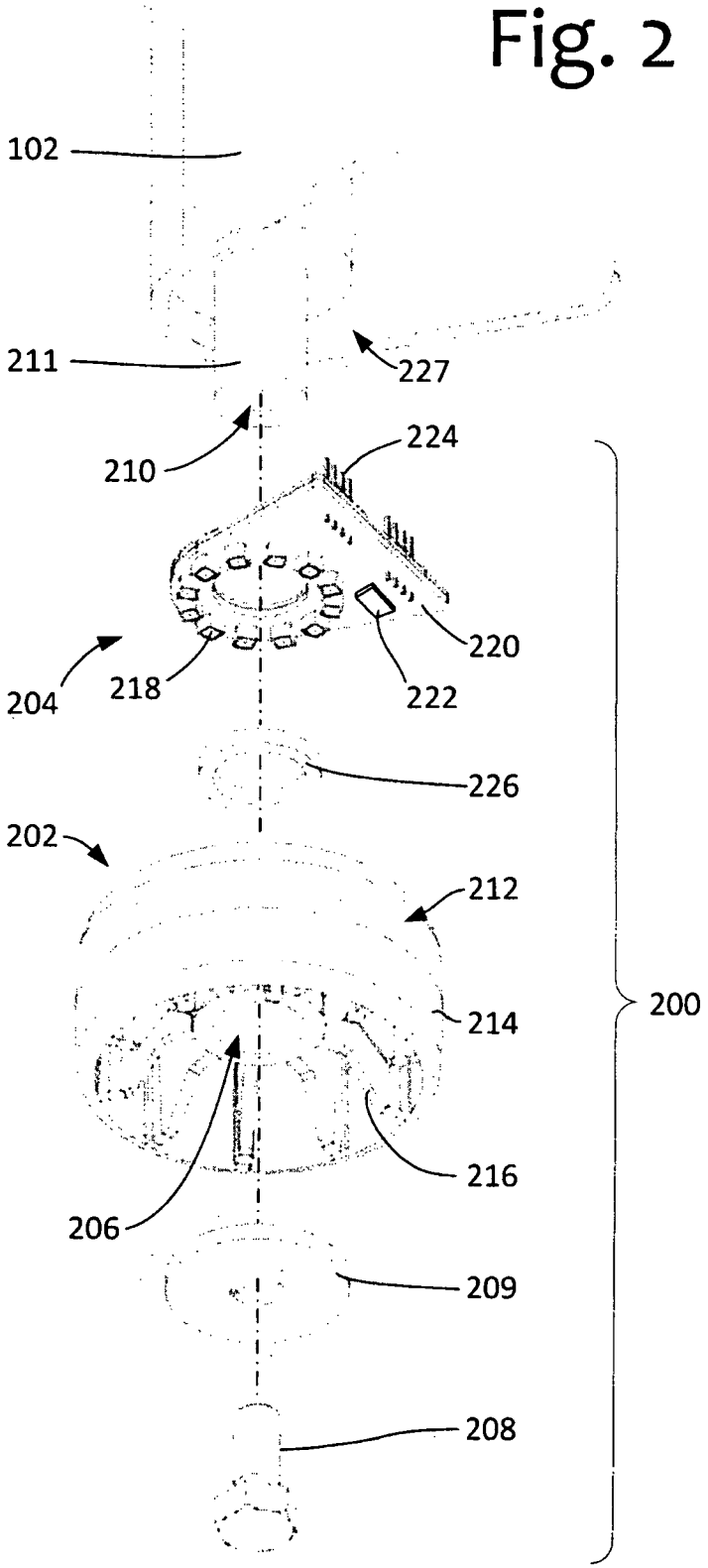
FIG. 2 is an exploded perspective view of the illuminable indicator and a portion of the corner of the bed, as viewed from below.

FIG. 2 shows the illuminable indicator 200 taken apart and removed from the bed 100. The illuminable indicator 200 includes a body 202 and a light source 204. The body 202 and light source 204 can each be of any shape, can be separate components, or can be integral with each other.

The body 202 is configured to be attached to the corner of the bed frame 102 by, in this embodiment, a through-hole 206 for receiving a bolt 208. The bolt 208 can be provided with a washer 209 and can be inserted through the hole 206 and threaded into a downward-facing threaded aperture 210 of a post 211 of the bed frame 102 to extend beneath the bed frame 102. In other embodiments, the body 202 can be attached to the bed 100 in other ways, such as by clamps.

The body 202 is substantially cylindrical in shape and has a substantially circular cross-section. In other embodiments, the body 202 can have other shapes, such as an octagonal extrusion or a rectangular prism.

The body 202 includes at least a light-transmitting portion 212, which in this embodiment includes an outer wall 214 and interior ribs 216. In this disclosure, light-transmitting may be taken to mean translucent, at least semi-transparent, fully transparent, or non-opaque. In this embodiment, the light-transmitting portion 212 of the body 202 is made of translucent or semi-transparent material and thus diffuses light received from the light source 204 such that the light-transmitting portion 212 of the body 202 appears to glow somewhat uniformly. The specific degree of translucency or semi-transparency can be selected to provide a desired diffusion of light.

The body 202 further includes a resilient portion, which in this embodiment is the same as the light-transmitting portion. That is, the outer wall 214 and interior ribs 216 are made of resilient material that is also translucent or semi-transparent. The geometry of the outer wall 214 and interior ribs 216 can further contribute to the resiliency of the body 202 by allowing flexure or compression under external load. For example, if the bed 100 is moved and the illuminable indicator 200 bumps into a door jamb, the outer wall 214 can bend inwards and one or more of the interior ribs 216 can buckle slightly to soften the impact.

The resilient portion of the body 202 should be rigid enough to hold its shape, flexible enough to deform and absorb energy due to impact, and durable enough to resist abrasion while being non-marking of surfaces. The resilient portion of the body 202 can be made of or at least include material having a hardness defined by a Shore A durometer of less than or equal to about 87, such as a Shore A durometer hardness of less than or equal to about 87 and greater than or equal to about 81. The resilient portion of the body 202 can include material having a Shore A durometer hardness of from 82 to 86, 83 to 85, or about 84. The resilient portion of the body 202 can be made from an elastomer or include an elastomeric component. The resilient portion of the body 202 may be made of a thermoplastic elastomer (TPE), such an SBS block copolymer, for example a DYNAFLEX™ TPE compound available from PolyOne Corp. of McHenry, Ill. Suitable resilient materials may also be light-transmitting. Such materials may be unfilled or filled with a light-transmitting or reflecting material.

In this embodiment, substantially the entire body 202 is light-transmitting and resilient. The body 202 can thus be made by a technique such as molding.

The light source 204 is positioned to emit light to at least the light transmitting portion of the body 202. In this embodiment, the light source 204 is external to the body and emits light on to the body 202, for example at a top face (ref. 500 of FIG. 5). In other embodiments, the light source 204 may be internal to the body 202. Light diffuses through the body 202 and exits via surfaces of the outer wall 214 and interior ribs 216.

The light source 204 can include one or more light elements 218. In this embodiment, the light elements 218 are light-emitting diodes (LEDs). In another embodiment, the light source 204 includes a single compact light bulb or a single LED. The LEDs 218 are disposed on a circuit board 220, which includes driving circuitry 222 for operating the LEDs 218. The LEDs 218 can be arranged in a circular arrangement as shown, or in another suitable arrangement. Leads or pins 224 are provided to electrically connect the driving circuitry 222 to a controller (ref. 700 of FIG. 7) via wires.

In this embodiment, the light source 204 is positioned above the body 202 and light emitted by the ring of LEDs 218 is directed downwardly onto the light-transmitting portion of the body 202. The LEDs 218 are external to the body 202 and spaced apart from the body 202 by a spacer 226, which is, for example, a plastic annular ring through which the bolt 208 extends. The spacer 226 can be sized to reduce the tendency of the body 202 to abut or crush the LEDs 218 when the bolt 208 is tightened. The spacer 226 can prevent the light source 204 from contacting the body 202 to reduce the chance of damage to either. By providing the light source 204 externally of the body 202, damage to the light source is substantially prevented upon impact of the resilient portion of the body 202 with obstacles. This improves the ability of the body 202 to function as both an illuminable indicator and a bumper for the bed 100. In addition, the body 202 is able to rotate about the bolt 208 without twisting of electrical wires, which could damage the indicator 200.

When the illuminable indicator 200 is assembled, the light source 204 is substantially enclosed by the body 202 and a cavity 227 of the bed 100 enclosing the threaded aperture 210. This protects the light source 204 from damage, since it is not exposed to interference with obstacles or tampering by people.

As mentioned, a single LED or a plurality of LEDs can be used as the light source 204. In this embodiment, the LEDs 218 are different types of LEDs interspersed with one another. The twelve LEDs 218 shown are of three colors R, G, B arranged in the following pattern: R-G-B-R-G-B-R-G-B-R-G-B. The colors R, G, B can be red, green, and blue, for example. Different colored LEDs can be interspersed according to different patterns. In another embodiment, two colors R and G are used in an alternating pattern. In still another embodiment, one color of LED is used. In yet another embodiment, the light source 204 can include one or more multicolor LEDs, such as a tricolor LED. The tricolor LED can be operable to emit a spectrum of colors by applying different voltages to different pins associated with each color. In other embodiments, a different kind of multicolored light source can be used instead of LEDs. Although twelve LEDs 218 are used in this example, more or fewer, such as six, can be used in other examples.

The LEDs 218 can be separately selectively illuminable. This can allow varied intensities of light to be emitted by the illuminable indicator 200. For example, if half the LEDs are lit then a less bright light is emitted by the illuminable indicator 200 than if all the LEDs are turned on. The same effect can be achieved with certain types of dimmable LEDs. Moreover, when different types of LED are used, selectively illuminating the LEDs can allow for different color schemes of light to be emitted by the illuminable indicator 200. Different types of LEDs can also be operated according to cooperative duty cycles. For example, red LEDs can be turned on and off each second in alternation with blue LEDs, thereby creating a flashing red and blue effect. The frequency of alternating red and blue pulses can be increased to create a color mixing effect.

The light source 204 can generally be configured to flash, irrespective of how many colors can be emitted by the light source 204. Flashing can be controlled according to an information-carrying pattern. For example, blinking the light source 204 at a first frequency can indicate a condition different from holding the light source 204 at steady output. Flashing the light source at a second frequency different from the first frequency can convey different information. In addition, when the bed 100 is provided with a plurality of illuminable indicators 200, the light sources 204 of the illuminable indicators 200 can be configured to flash in a synchronized manner. For example, the left and right illuminable indicators 200 can be flashed alternately.

The light source 204 can generally be configured to be dimmed or brightened. As mentioned, this can be controlled by an LED duty cycle. In other examples, other dimming or brightening techniques can be used to control the intensity of illumination provided by the illuminable indicator 200.

Generally, the light source 204 of any of the illuminable indicators 200 can be configured to emit light at any color, rate of flashing, intensity, and combinations of such to convey information to an observer.

Figure 3:
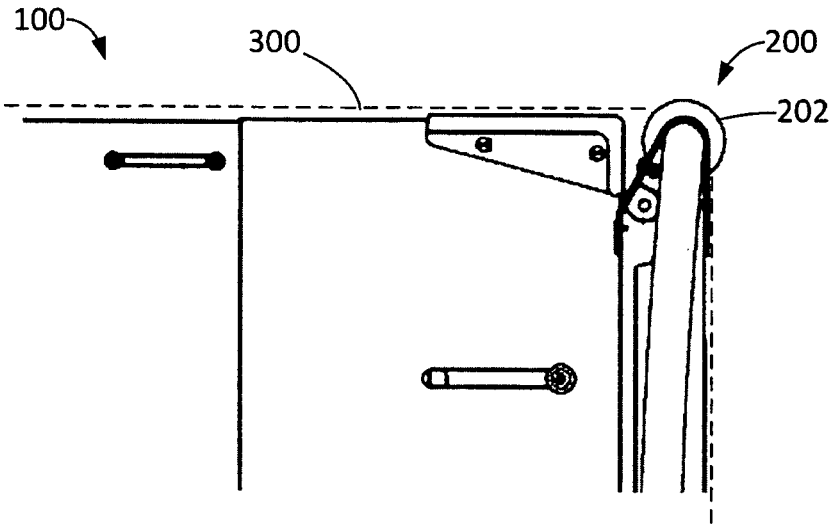
FIG. 3 is a top view of the illuminable indicator and portion of the corner of the bed.

FIG. 3 shows the illuminable indicator 200 attached to the bed 100, when looking down from above. As can be seen, in this embodiment, the cylindrical shape of the body 202 is of a diameter that allows the body 202 to protrude from an outer perimeter 300 of the bed, 100. The body 202 protrudes outwardly from both the side and the end of the bed. The illuminable indicator 200, particularly when including a resilient portion, can thus be used as a bumper. That is, when the bed 100 is rolled to another location and collides with a wall or other object, the body 202, which in this instance is made of TPE, softens or absorbs a portion of the impact. This can reduce the possibility of damage to the bed 100 or object struck, as well as reducing the jolt to the bed's occupant. The outer perimeter 300 of the bed 100 can include the side rails 110 or not. The outer perimeter 300 can be a local outer perimeter of a region of the bed 100 that tends to experience a significant number of collisions.

It should also be apparent from FIG. 3 that the cylindrical shape of the body 202 can make attachment of the illuminable indicator 200 to the bed 100 easier. That is, the body 202 can be correctly installed without the installer needing to pay attention to the orientation of the body 202. This allows for ease of installation, service and replacement, even by unskilled personnel.

Figure 4:
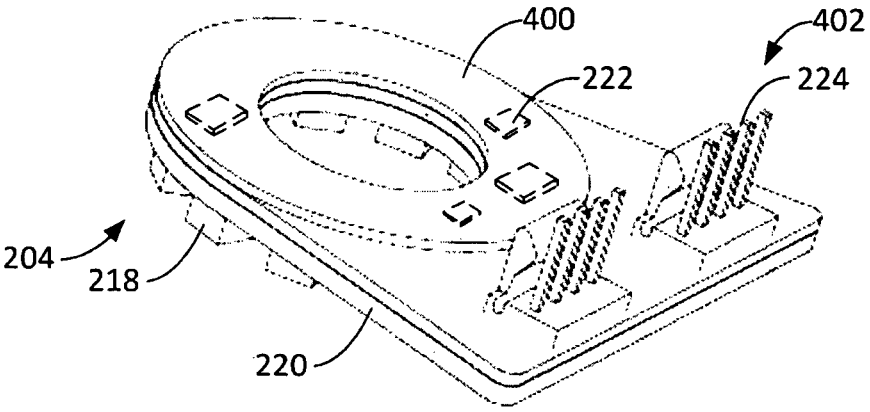
FIG. 4 is top perspective view of the circuit board that drives the light source of the illuminable indicator.

FIG. 4 shows a top perspective view of the circuit board 220 that drives the light source 204. A nonconductive coating 400 is applied to the top of the circuit board 220 to prevent shorting of circuitry 222 on metal of the bed 100. The nonconductive coating 400 may be resilient to prevent damage to the circuit board in the event of over-tightening of the bolt 208. The nonconductive coating 400 can be a polymer coating. Also shown are connectors 402 for removably connecting wires to the pins 224. In an alternative embodiment, a nonconductive sheet is laid on top of the circuit board 220. Nonconductive may also be referred to as dielectric or electrically insulating.

Figure 5:
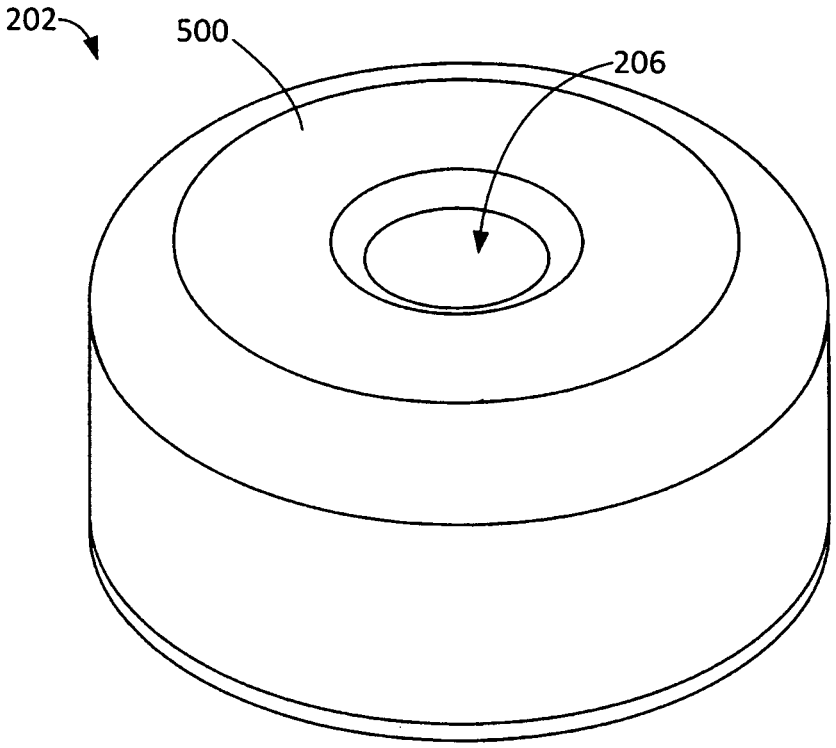
FIG. 5 is a top perspective view of the body of the illuminable indicator.

FIG. 5 shows the body 202 as viewed from above. The body 202 can include a substantially flat face 500 that is positioned adjacent the light source 204 so that the light source 204 can direct light towards the flat face 500. The flat face 500 is one example of a surface for light to enter into the body 202.

Figure 6:
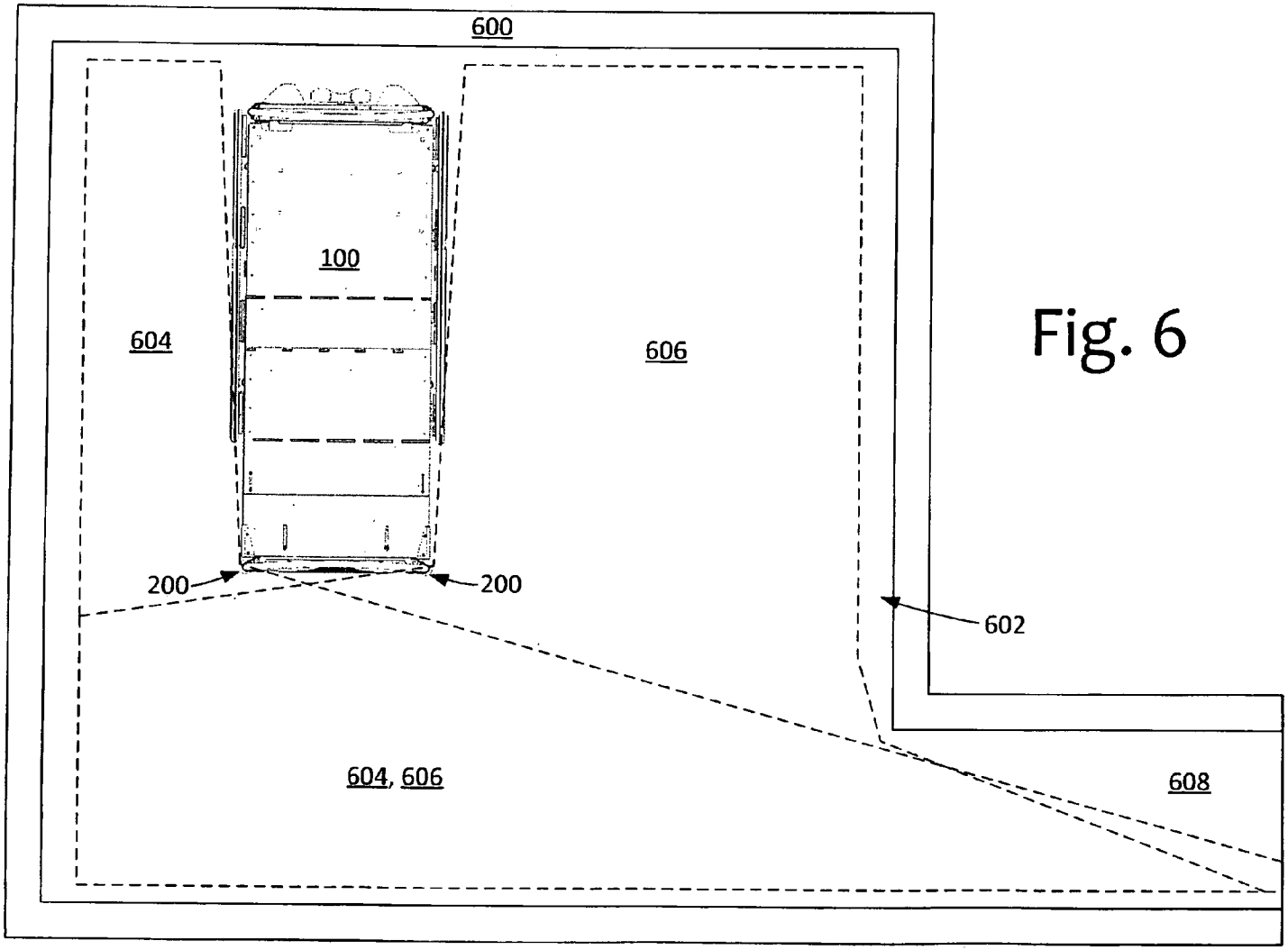
FIG. 6 is a schematic diagram of the bed positioned against a wall of a room.

FIG. 6 shows a schematic of the bed 100 positioned against a wall 600 of a room 602. The plurality of illuminable indicators 200 is arranged on the bed 100 to cast light to substantially all vantage points around the bed 100 to convey information to anyone, such as a nurse or attendant, in view of the bed 100, regardless of the height position or articulation of the bed 100. As can be seen, left and right fields of light 604, 606 cast by the left and right illuminable indicators 200 reach substantially all areas of the room 602, extend out the hallway 608, and overlap by a certain amount. The shape and position of the illuminable indicators 200 allows for a wide and direct casting of light without needing to rely on reflection of light off the floor, which in some situations may not be reflective enough.

Figure 7:
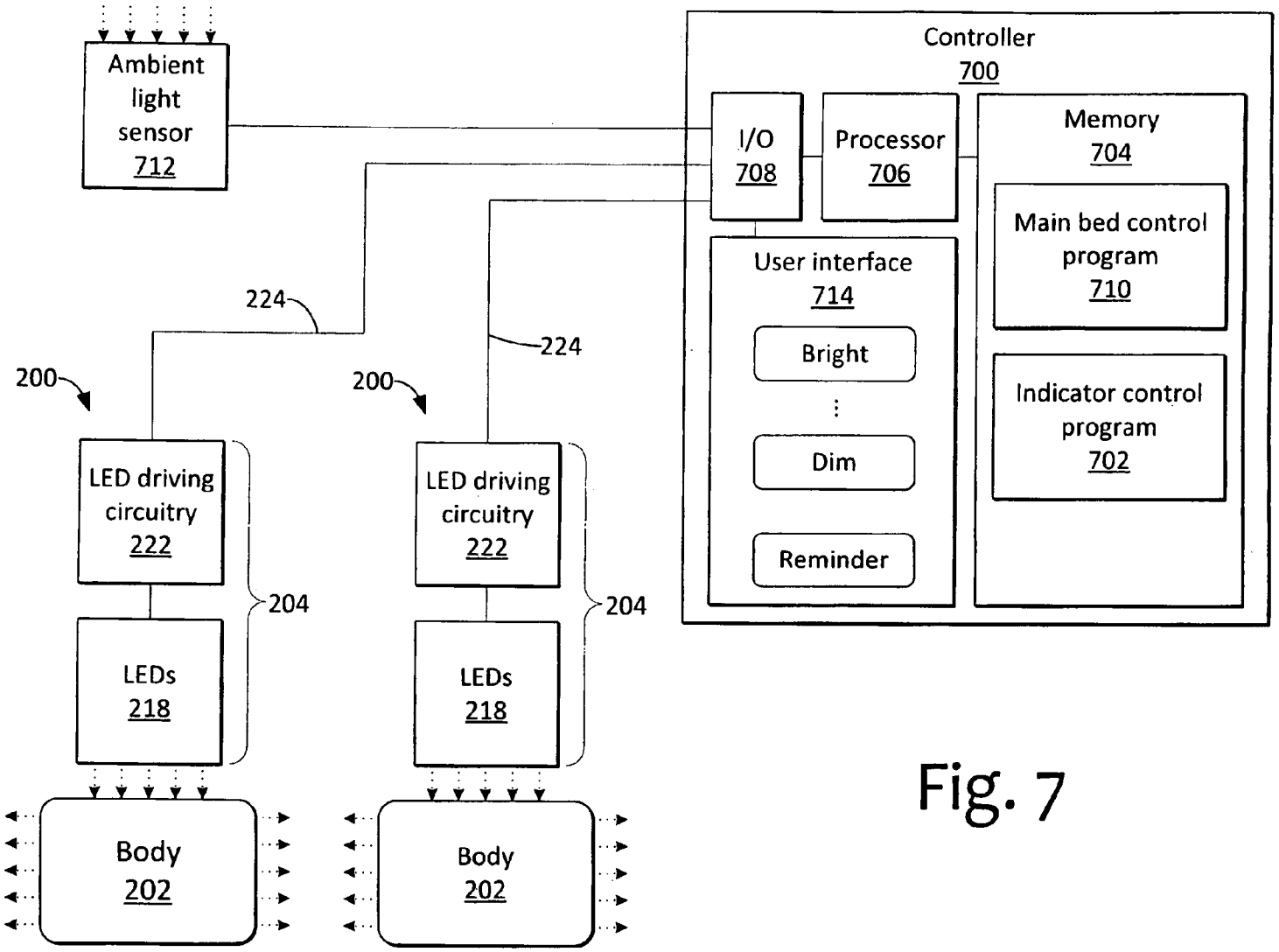
FIG. 7 is a block diagram showing a controller.

With reference to FIG. 7, a controller 700 can be programmed to control the light source 204 to operate according to an indicator control program 702 to selectively illuminate the body 202 of each of the illuminable indicators 200. The program 702 can be stored in software, hardware, firmware, or a combination of such. In one example, the program is written in a language, such as one of the C family of languages, and stored and executed as software. In another example, the program is implemented as a hardware logic circuit comprising logic gates. In yet another example, the program is implemented as an analog or RLC circuit.

In this example, the program 702 is stored in a memory 704 of the controller 700. A processor 706 is connected to the memory 704 to access and execute the program. 702 to control the driving circuitry 222 of the light source 204 to illuminate the LEDs 218 accordingly (with dashed lines indicating light). The driving circuitry 222 of the light sources is connected to the processor 706 via an input/output (I/O) circuit 708, such as an I/O bus.

In one example of the program 702, when the light source 204 is configured to selectively emit three different colors of light, the three different colors can be selectively illuminated by the processor 706 to indicate three different conditions related to the bed's occupant, the bed itself, or nearby equipment, as discussed above. These conditions can be, for example, a normal condition (e.g., red), a warning condition (e.g., green), and an alarm condition (e.g., blue or yellow). The input for this program 702 can come from sources such as a patient exit alarm, the bed's main control program 710, or the like.

The program 702 can be part of the bed's main control program 710, which can control the height, tilt, etc. of the bed 100. For example, the program 702 can include one or more of a subroutine, a function, a module, a class, an object, or another programmatic entity of the bed's main control program 710.

An ambient light sensor 712 can be provided to the bed 100. The ambient light sensor 712 can be positioned on the bed 100 to detect a level of ambient light from, for example, overhead lighting and windows. The ambient light sensor 712 is connected to the processor 706 via the I/O circuit 708. The indicator control program 702 references ambient light readings from the sensor 712 to allow the processor 706 to control the light sources 204 to provide an intensity of illumination that is, for example, not too bright in a dark room or not too dim in a well-lit room.

A user interface 714 can be provided to the controller 704. The user interface 714 can communicate with the processor 706 via the I/O circuit 708. The user interface 714 can include buttons, or other input devices, that allow direct human control of aspects of the illuminable indicators 200. For example, levels of light intensity ranging from "bright" to "dim" can be selected via the user interface 714, and the program 702 can use the selected level to override or modify a level determined using the ambient light sensor 712.

The user interface 714 can further include a button, or other input device, for setting a reminder that utilizes the illuminable indicators 200 as an alert for the reminder. In this embodiment, the indicator control program 702 is configured to receive an input to start a timer for a predetermined timed duration, which can be a duration such as 5 minutes, 15 minutes, 1 hour, etc. The predetermined timed duration can be hardcoded in the program 702 or received as a user selection at the user interface 714. Then, after the program 702 determines that the duration has elapsed, the program 702 triggers the illumination of the illuminable indicators 200 to alert whomever set the reminder that the duration has elapsed. The illuminable indicators 200 can be lit to uniquely signify the elapsing of the timer. For example, illuminable indicators 200 can be flashed yellow. Since the illuminable indicators are highly visible, even from the hallway, the alert can be used to remind attendants passing the patient's room of the need to perform a specific task. The reminder alert can also be triggered in the event of certain conditions being met relating to the bed, the bed occupant, or connected equipment.

FIGS. 8*a-b* show a first alternative body 800 for an illuminable indicator. The body 800 can be used with any of the illuminable indicators described herein.

The body 800 includes a central solid or rigid portion 802 that has a through-hole 804 for receiving a bolt for attaching the body 800 to the bed 100. The central portion 802 is generally not resilient. In one example, the central portion 802 is not light transmitting. In another example, the central portion 802 is light transmitting and receives light at a top surface 806 from a light source.

The body 800 further includes an outer portion 808 that is resilient and optionally light transmitting. The outer portion 808 can be friction fit to the central portion 802. The outer, portion 808 can receive light from the central portion 802, if the central portion 802 is light transmitting, or from a light source at a top surface 810. In other aspects, the outer portion 808 can be similar to any of the resilient and light transmitting portions described elsewhere herein, such as the body 202.

FIGS. 9*a-b* show a second alternative body 900 for an illuminable indicator. The body 900 can be used with any of the illuminable indicators described herein.

The body 900 includes an elongate central portion 902 that is light transmitting extending downwards from a relatively opaque resilient portion 904. The central portion 902 can receive light from a light source at a top surface 906. Since the central portion 902 extends beyond the lower extent of the opaque resilient portion 904, the central portion 902 is visible and can thus be illuminated to convey information to an observer. The opaque resilient portion 904 can act as a bumper. The portions 902, 904 can be cylindrical or any other shape and can be friction fit or otherwise held together. The central portion 902 can include a through-hole 908 to receive a bolt to secure the body 900 to the bed 100.

FIGS. 10*a-b* show a third alternative body 1000 for an illuminable indicator. The body 1000 can be used with any of the illuminable indicators described herein.

The body 1000 includes an opaque resilient portion 1002 that can be bolted to the bed 100 via a mounting hole 1004 to act as a bumper. A plurality of channels 1008 are provided in the opaque resilient portion 1002 fanning from a top surface 1010 to an outer surface 1012, which in this example is an outer cylindrical surface. Inserted into each channel 1008 is an optical fiber 1014 which ends at a recess 1016 in the outer surface 1012 and starts at a light source, which can be located anywhere on or near the bed 100. In one embodiment, the fibers 1014 extend out of the top surface 1010 and the light source is spaced apart from and shines downwardly on to the fibers 1014 in a manner as described elsewhere in connection with other embodiments. The optical fibers 1014 convey remotely applied light to the outside of the body 1000 and can thus convey information to an observer.

FIGS. 11*a-b* show a fourth alternative body 1100 for an illuminable indicator. The body 1100 can be used with any of the illuminable indicators described herein.

The body 1100 includes a central light transmitting portion 1102, which can be cylindrical as depicted. The central light transmitting portion 1102 includes a mounting hole 1104 to receive a bolt for fixing the body 1100 to the bed 100. An opaque resilient outer portion 1106 surrounds the central light transmitting portion 1102 and acts as a bumper. The outer portion 1106 has openings 1108 around its circumference that allow light emitted into a top surface 1110 of the central portion 1102 to pass and thus convey information that can be observed by a nearby nurse or attendant. The outer portion 1106 and central portion 1102 can be fixed together by any suitable technique, such as friction fitting.

While the foregoing provides certain non-limiting example embodiments, it should be understood that combinations, subsets, and variations of the foregoing are contemplated. The monopoly sought is defined by the claims.

What is claimed is:

1. An illuminable indicator for a bed, the illuminable indicator comprising:

a body configured to be attached to the bed, the body comprising at least a resilient and light-transmitting portion shaped to protrude from an outer perimeter of the bed when attached to the bed; and a light source positioned to emit light to the resilient and light-transmitting portion, the light source configured to illuminate the body.

2. The illuminable indicator of claim 1, wherein the resilient and light-transmitting portion comprises a wall of the body.

3. The illuminable indicator of claim 2, wherein said resilient and light transmitting portion has sufficient resiliency to bend said wall inwardly upon impact with an object to form a bumper.

4. The illuminable indicator of claim 1, wherein said resilient and light transmitting portion forms a bumper.

5. A bed in combination with an illuminable indicator according to claim 1, said bed comprising a bed frame for supporting a mattress, and said body mounted to a corner of said bed frame and dimensioned to protrude beyond the bed frame and thereby protrude beyond a side and an end of said bed frame wherein light from said indicator projects from said side and said end of said bed frame.

6. A bed according to claim 5, said body extending beneath the bed frame.

7. A bed of claim 6, further comprising a plurality of said illuminable indicators, each of said illuminable indicators be mounted to a respective corner of the bed frame.

8. A bed of claim 6, wherein the body is configured to be attached within a cavity of the bed frame beneath the bed frame.

9. A bed according to claim 5, wherein said light source has a plurality of light elements external to said body and positioned to emit light on to said light-transmitting portion, said plurality of light elements configured to illuminate said body, said plurality of light elements arranged in a substantially circular arrangement.

10. A bed of claim 9, wherein the plurality of light elements is configured to emit light downwardly on to the light-transmitting portion.

11. The illuminable indicator of claim 1, wherein the body is substantially cylindrical in shape.

12. The illuminable indicator of claim 1, wherein the light-transmitting portion comprises at least one substantially flat face and the light source is positioned to direct light towards the flat face.

13. The illuminable indicator of claim 1, wherein substantially the entire body is light-transmitting and resilient.

14. The illuminable indicator of claim 1, wherein the body is shaped as a bed bumper.

15. The illuminable indicator of claim 1, wherein the light source is positioned above the body and light emitted by the light source is directed downwardly onto the light-transmitting portion.

16. The illuminable indicator of claim 1, wherein the light source comprises at least one light-emitting diode.

17. The illuminable indicator of claim 1, wherein the light source comprises a first light element and a second light element interspersed with one another.

18. The illuminable indicator of claim 17, wherein the first and second light elements are different.

19. The illuminable indicator of claim 17, wherein there are a plurality of first light elements and a plurality of second light elements.

20. The illuminable indicator of claim 19, wherein the plurality of first and second light elements are separately selectively illuminable.

21. The illuminable indicator of claim 19, wherein the plurality of first and second light elements are configured to operate according to cooperative duty cycles.

22. The illuminable indicator of claim 19, wherein the plurality of first light elements emit a first color of light when illuminated and the plurality of second light elements emit a second color of light when illuminated, the first and second colors of light being different from one another.

23. The illuminable indicator of claim 17, wherein the light source further comprises a third light element interspersed with the first and second light elements.

24. The illuminable indicator of claim 23, wherein the third light element is different from the first and second light elements.

25. The illuminable indicator of claim 23, wherein there are a plurality of third light elements.

26. The illuminable indicator of claim 1, wherein the light source comprises a multicolor light source.

27. The illuminable indicator of claim 26, wherein the light source comprises a multicolor light-emitting diode.

28. The illuminable indicator of claim 27, wherein the light source comprises a tricolor light-emitting diode.

29. The illuminable indicator of claim 28, where the tricolor light-emitting diode is operable to emit a spectrum of colors.

30. The illuminable indicator of claim 1, wherein the light source is configured to selectively emit three different colors of light indicative of three different conditions being a normal condition, a warning condition, and an alarm condition.

31. The illuminable indicator of claim 1, wherein the light source is configured to flash.

32. The illuminable indicator of claim 31, wherein the light source is configured to flash according to an information-carrying pattern.

33. The illuminable indicator of claim 31, wherein a plurality of illuminable indicators have light sources configured to flash in synchronization.

34. The illuminable indicator of claim 1, wherein the light source is configured to be dimmed or brightened.

35. The illuminable indicator of claim 34, wherein the light source is configured to be dimmed or brightened according to an input at a control panel of the bed.

36. The illuminable indicator of claim 1, wherein the light source is configured to operate according to a duty cycle.

37. The illuminable indicator of claim 1, wherein the light source is configured to emit light according to a reminder alert.

38. A bed comprising:

a bed frame;

a wheeled leg assembly attached to the bed fame and configured to allow the bed to be moved to different locations of a floor; and a plurality of illuminable indicators configured to illuminate to convey information, each of the illuminable indicators coupled to at least one of the bed frame and the wheeled leg assembly, the plurality of illuminable indicators arranged on the bed to directly cast light to substantially all vantage points around the bed, each illuminable indicator comprising a resilient body having sufficient resiliency to deform and absorb energy to form a bumper.

* * * * *